US006563255B1

(12) United States Patent
Collins

(10) Patent No.: US 6,563,255 B1
(45) Date of Patent: May 13, 2003

(54) LUMINAIRE INCORPORATING ARC TUBE PREHEATER

(75) Inventor: Byron R. Collins, Tuxedo, NC (US)

(73) Assignee: General Electric Company, Schenectady, NY (US)

( * ) Notice: Subject to any disclaimer, the term of this patent is extended or adjusted under 35 U.S.C. 154(b) by 209 days.

(21) Appl. No.: 09/692,286

(22) Filed: Oct. 19, 2000

(51) Int. Cl.[7] ..... H01K 1/26; F21S 13/14
(52) U.S. Cl. ..... 313/113; 362/296; 313/110
(58) Field of Search ..... 362/304, 296, 362/211, 227, 231, 236, 240, 321, 280, 323; 313/110, 111, 112, 113, 114, 115, 635

(56) References Cited

U.S. PATENT DOCUMENTS

| | | | | |
|---|---|---|---|---|
| 3,733,481 | A | | 5/1973 | Kuyt |
| 4,241,382 | A | | 12/1980 | Daniel |
| 4,612,478 | A | | 9/1986 | Payne |
| 4,723,097 | A | | 2/1988 | Heindl et al. |
| 4,755,918 | A | | 7/1988 | Pristash et al. |
| 4,931,701 | A | | 6/1990 | Carl |
| 5,079,683 | A | * | 1/1992 | McGuire ..... 362/321 |
| 5,143,445 | A | | 9/1992 | Bateman et al. |
| 5,327,048 | A | | 7/1994 | Troy |
| 5,339,198 | A | | 8/1994 | Wheatly et al. |
| 5,353,210 | A | | 10/1994 | Strok et al. |
| 5,400,223 | A | | 3/1995 | Speaker et al. |
| 5,444,334 | A | | 8/1995 | Speaker et al. |
| 5,451,843 | A | | 9/1995 | Kahn et al. |
| 5,586,015 | A | | 12/1996 | Baldwin et al. |
| 5,811,939 | A | | 9/1998 | Herniak |
| 5,887,970 | A | | 3/1999 | Payne |
| 5,898,273 | A | | 4/1999 | Collins et al. |
| 5,909,082 | A | | 6/1999 | Speaker et al. |
| 6,031,340 | A | | 2/2000 | Brosius |

OTHER PUBLICATIONS

Payne Sparkman Manufacturing, Inc., LiteWorks™/Lite Shades information sheets (4 pages), New Albany, Indiana, (1999).

Phoebus Manufacturing, "The Shutter" information sheet (1 page), San Francisco, California (date unknown).

Musco Lighting, ShowLight™ information sheets (2 pages), Oskaloosa, Iowa (date unknown).

Sterner Sports Lighting, "Arena Lighting" information sheets (2 pages), (date unknown).

S. Cohen, W. C. Gungle, J. J. Gutta, A. W. Olsen, D. A. Richardson, "Heat Starting a High–Pressure Sodium Lamp," Journal of IES, Jul. 1974, pp. 330–335.

* cited by examiner

*Primary Examiner*—Nimeshkumar D. Patel
*Assistant Examiner*—Sharlene Leurig
(74) *Attorney, Agent, or Firm*—Fay, Sharpe, Fagan, Minnich & McKee, LLP

(57) ABSTRACT

A high intensity discharge (HID) lamp luminaire including a heater for eating the lamp arc tube prior to starting. Preheating the arc tube decreases the amount of damage done by starting, and additionally reduces warm-up time. An illumination reflector has an open end for light output, and an apex. The arc tube contains an ionizable fill and a pair of electrodes and is mounted generally in front of the rear apex, such as within the illumination reflector between the open end and the apex. At least a portion of the illumination reflector is a dichroic element which is relatively reflective of visible light and relatively transmissive of infrared radiation. A source of infrared radiation, such as an incandescent heat lamp, is located outside the illumination reflector, such as generally behind the apex, for directing infrared radiation through the dichroic element portion of the illumination reflector to heat the arc tube. A shield is located within the illumination reflector between the open end and the apex, and serves the multiple purposes of reflecting infrared radiation for enhancing heating of the arc tube by the source of infrared radiation, blocking light from the arc tube (which light includes ultraviolet radiation) from radiating directly out of the open end of the reflector, and as a shatter shield in the event of non-passive failure of the arc tube. The illumination reflector absorbs ultraviolet radiation.

22 Claims, 3 Drawing Sheets

LUMINAIRE INCORPORATING ARC TUBE PREHEATER

BACKGROUND OF THE INVENTION

The invention relates to luminaires including arc tube lamps such as metal halide high intensity gas discharge lamps and, more particularly, to a luminaire including a heater for heating the lamp arc tube prior to starting the lamp.

High intensity gas discharge (HID) lamps are employed in a wide variety of applications including street lighting, industrial lighting, and lighting for sporting events. A disadvantage of high intensity gas discharge lamps is that they in general cannot be turned off and on quickly or frequently. For example, in order to reduce power consumption, it is desirable to turn lamps off when light is not required. For sports lighting applications, it is desirable to produce theatrical effects such as introducing players into a darkened arena with a spotlight on a particular player, and thereafter turning the arena lights back on.

There are however several fundamental problems associated with the operation of HID lamps. One fundamental problem is that the starting process for a high intensity gas discharge lamp normally causes damage to the lamp such that light output is slightly reduced for each start. Thus, high intensity gas discharge lamps are generally rated to operate for ten hours per start, and any reduction in the on period usually results in significant Lamp Lumen Depreciation. Another fundamental problem is that high intensity gas discharge lamps require a warm-up period, and it may take several minutes for the light output to reach even 90% of the fully warmed-up level. In an industrial lighting application, turning off lamps when light is not required likely would reduce the on-periods to less than ten hours per start. Moreover, adequate illumination may not be provided for the first several minutes after lamps are started. These problems can be exacerbated in sports lighting applications.

One general way the above-mentioned problems can be minimized is by preheating the arc tube, prior to starting. Preheating the arc tube decreases the amount of damage done by starting, and additionally reduces the warm-up time. One known technique is to provide a heater for the arc tube, such as is disclosed in Collins et al U.S. Pat. No. 5,898,273.

Another technique, closely related to preheating, is to dim a metal halide HID lamp by operating it at reduced power, such as one-half power, as is done in commercially available bi-level systems. When full power is subsequently desired, the arc tube has in effect been pre-heated. Nevertheless, disadvantages remain. Operating the lamp at a reduced power level still consumes a significant amount of power, and Lamp Lumen Depreciation occurs even in dimmed mode. Metal halide HID lamps tend to be inefficient and produce a poorer quality of light in the dimmed mode (degraded color temperature and color rendering index).

Also, both approaches result in light output from the luminaire in situations where a more darkened luminaire would be desirable for theatrical purposes. A preheater such as is disclosed in Collins et al U.S. Pat. No. 5,898,273 is an incandescent heat lamp, which also produces visible light. A dimmed lamp in a bi-level system produces illumination (which may be intentional and desirable in some applications).

Deserving mention in the context of the invention is an entirely different prior art approach, particularly in sports lighting applications, which is to employ a mechanical shutter system to block the light from the luminaire. An example is disclosed in Payne U.S. Pat. No. 5,887,970. Opening the shutter provides "instant" light. Mechanical shutter systems have the disadvantage of heat build-up while the shutter is closed, and do not in any way address the desire to reduce power consumption by turning lamps off when not in use.

BRIEF SUMMARY OF THE INVENTION

It is therefore seen to be desirable to provide a luminaire including an arc tube preheater, in which visible light from the arc tube preheater is minimized.

In an exemplary embodiment, a luminaire includes an illumination reflector having a forward, light-projecting open end and a rear apex. An arc tube containing an ionizable fill and a pair of electrodes is mounted in front of the rear apex. At least a portion of the illumination reflector is a dichroic element which is relatively reflective of visible light and relatively transmissive of infrared radiation. A source of infrared radiation is located outside the illumination reflector for directing infrared radiation through the dichroic element portion of the illumination reflector to heat the arc tube.

Thus, the arc tube can be preheated to improve Lamp Lumen Depreciation, and to allow higher initial light levels after turn-on and faster warm-up. The location of the source of infrared radiation outside the illumination reflector minimizes the amount of visible light from the source of infrared radiation which enters the interior of the illumination reflector, allowing the luminaire to appear relatively dark during preheat. Heating of the arc tube can be accomplished either prior to initial starting of the arc tube, or after the arc tube lamp has been in operation and is turned off prior to a re-start. The terms "preheat" and "heat" are employed herein interchangeably, and are intended to refer to either circumstance.

DETAILED DESCRIPTION OF THE INVENTION

Figure 1:
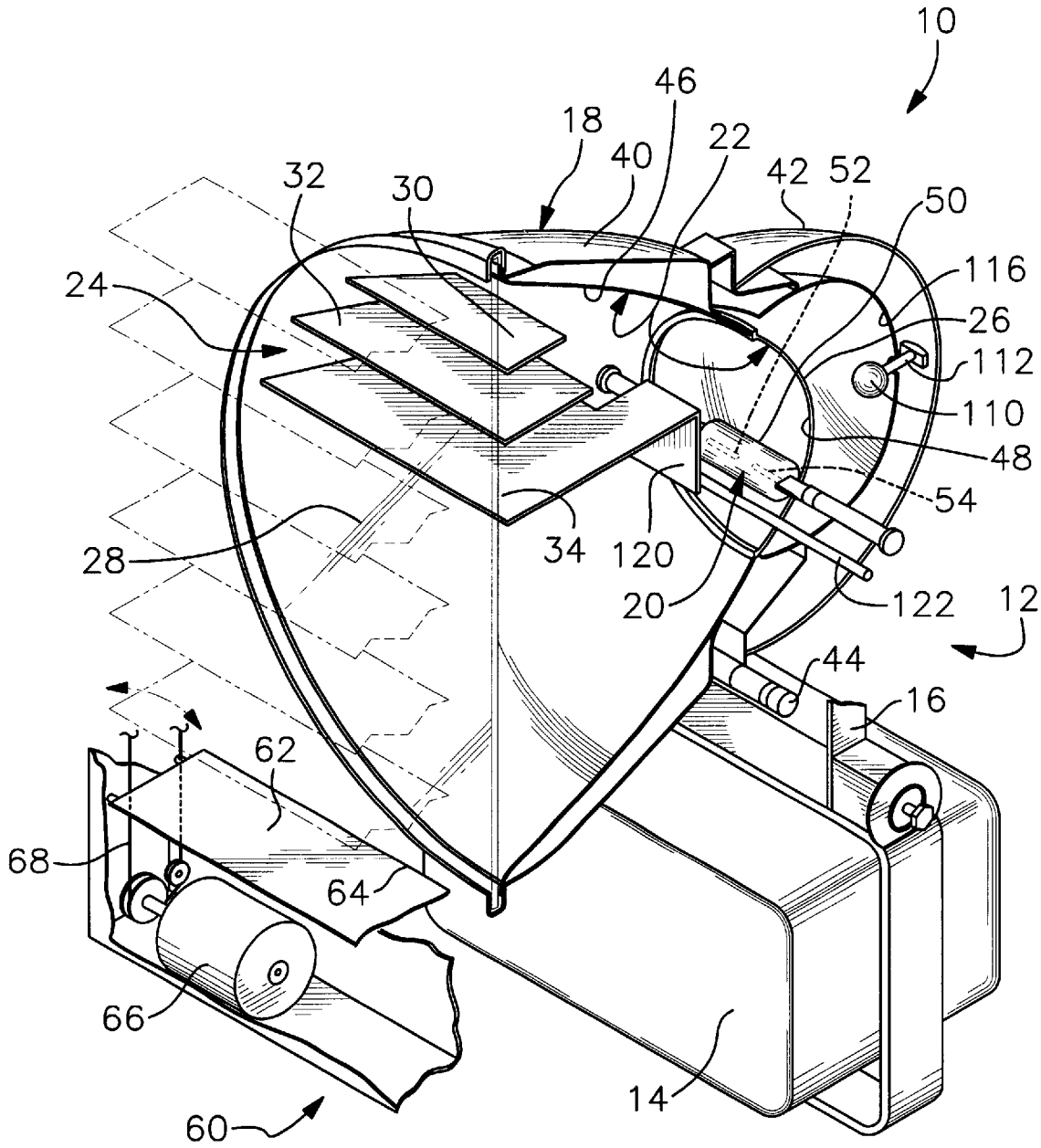
FIG. 1 is a three-dimensional view, partially broken away, of a luminaire embodying the invention.
Figure 2:
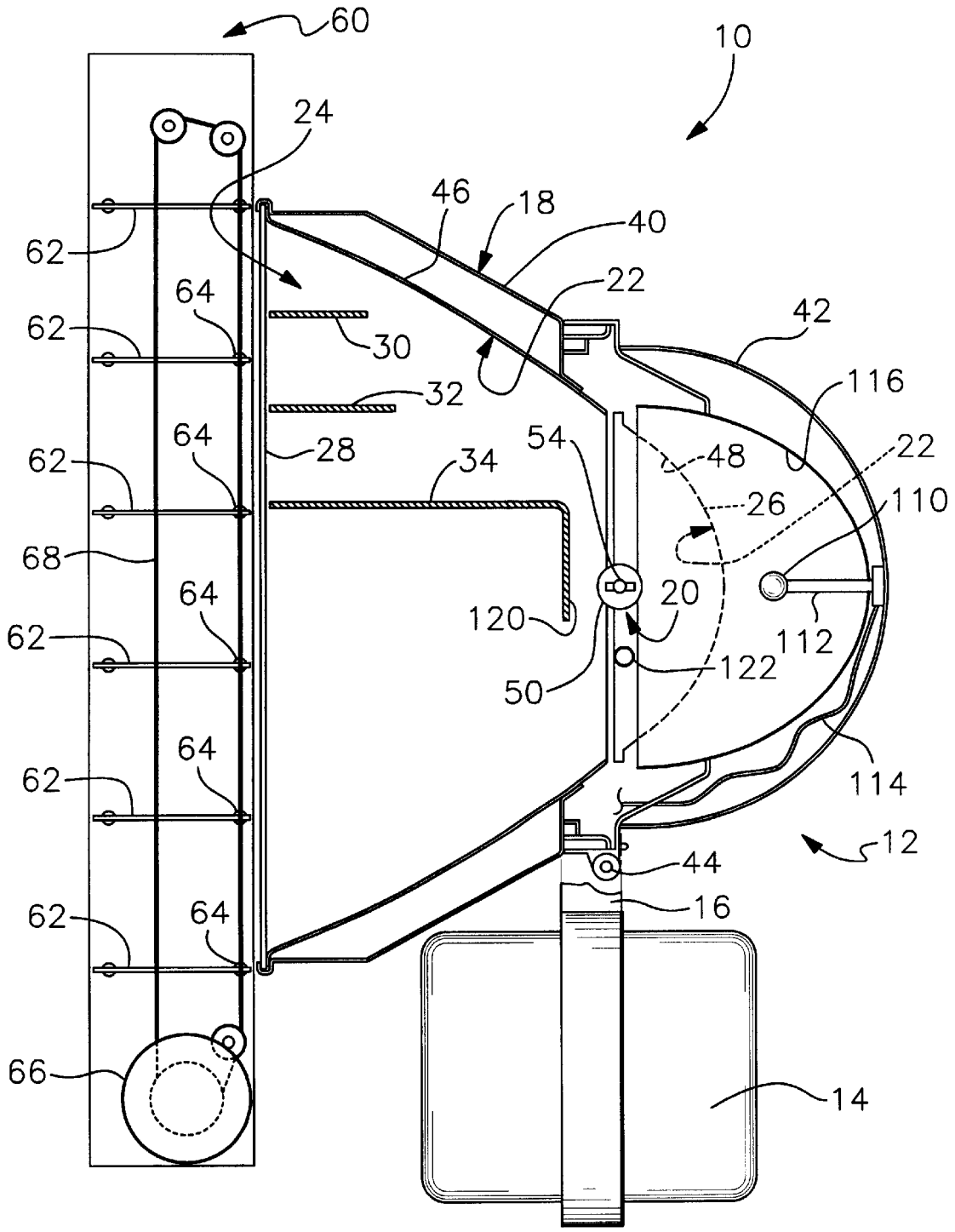
FIG. 2 is a side sectional view of the luminaire of FIG. 1.

Referring first to FIGS. 1 and 2, a luminaire 10 embodying the invention is, for purposes of example, a modified form of the luminaire disclosed in Baldwin et al U.S. Pat. No. 5,586,015 and Speaker et al U.S. Pat. No. 5,400,223. The invention, however, may be embodied in a wide variety of luminaires, and is not limited to the particular type of luminaire illustrated.

The luminaire 10 includes an optical portion, generally designated 12, a ballast and ballast housing portion generally designated 14, and a support 16 physically connecting the optical portion 12 to the ballast portion 14.

The optical portion 12 includes a housing 18 for a high intensity discharge (HID) lamp 20, in particular, a metal halide lamp 20. The housing 18 includes an illumination reflector 22 having a forward, light-projecting open end 24, and a rear apex 26. A tempered glass cover 28 is provided over the open end 24. In the exemplary luminaire 10, within the upper half of the illumination reflector 22 is a set of three fixed optical louvers 30, 32 and 34, which serve to reduce glare or spill light on to areas above the playing surface of a sports field.

The housing 18 has two sections, a fixed main portion 40 and a rear relamp door portion 42. The relamp door portion 42 is hinged at 44 and pivots away to provide convenient access to the lamp 20. Correspondingly, the illumination reflector 22 has two sections, a fixed forward section 46 supported by the main portion 40, and a rear section 48 (including the apex 26) supported by the relamp door portion 42.

The high intensity discharge lamp 20 is mounted generally in front of the rear apex 26. In the illustrated embodiment, the lamp 20 is mounted within the illumination reflector 22 between the open end 24 and the apex 26. The lamp 20 comprises an arc tube 50 made of quartz or ceramic. The arc tube 50 contains an ionizable fill and a pair of electrodes 52 and 54 at opposite ends, although the invention may also be embodied in a luminaire employing an electrodeless lamp. During operation, electrical current from the ballast 14 is applied to the electrodes 52 and 54, and an electrical arc discharge between the electrodes 52 and 54 provides illumination.

The particular luminaire 10 embodiment illustrated has an optional shutter system 60, generally over the open end 24, outside the glass cover 28. The shutter system 60 includes a set of movable louvers 62 that rotate about pivot points 64, and are driven by a shutter system motor 66 via a linkage 68. Unlike prior art shutter systems wherein the sole purpose is to block light from a luminaire, a purpose and function of the shutter system 60 is to assist in preheating the arc tube 50. However, another function of the shutter system 60 is to block light, particularly during preheat, as is described hereinbelow.

As in the luminaire of Baldwin et al U.S. Pat. No. 5,586,015, at least a portion of the illumination reflector 22 is a dichroic element which is relatively reflective of visible light (e.g. having a reflectance of about 95% of radiation having wavelengths within the approximate range of 400 mm to 700 mm) and relatively transmissive of infrared radiation (e.g. transmitting about 80% of radiation having wavelengths greater than approximately 900 mm. These characteristics give rise to the terminology "cold mirror." When used as an illumination reflector in a lighting system, the desired visible light from a lamp is reflected onto an object to be illuminated, while infrared radiation is transmitted through the cold mirror and away from the object. This minimizes heating and potential damage to the illuminated objects. In addition, internal heating of an enclosed luminaire is reduced, since infrared radiation from the lamp is transmitted out through the illumination reflector. Cold mirrors are currently widely used in lighting systems for projectors, for lighting in studios and theaters, art displays, shop windows, and in security and medical applications. As another advantage, the visible light reflectance of about 95% is superior to the 80% reflectance of a typical aluminum reflector.

In the embodiment of FIGS. 1 and 2, the portion of the illumination reflector 22 which is a dichroic element relatively reflective of visible light and relatively transmissive of infrared radiation is the rear section 48, and encompasses the rear apex 26. The fixed forward section 46 is a conventional reflector.

A dichroic element, more specifically a cold mirror, suitable for use as the dichroic element portion 48 of the illumination reflector 22 is disclosed in greater detail in Bateman et al U.S. Pat. No. 5,143,445. Thus, and with reference to the cross-sectional view of FIG. 3, the illumination reflector dichroic element portion 48 comprises a glass substrate 70 having internal and external surfaces 72 and 74, respectively. Multi-layer interference coatings 76 and 78 are provided on the respective surfaces 72 and 74. Each of the interference coatings 76 and 78 comprises alternating thin films of materials 80 and 82 having different indices of refraction, such as silica and titania. In addition, there is an ultraviolet (UV)-absorbing coating layer 84, such as is disclosed in Strok et al U.S. Pat. No. 5,353,210. A suitable material for the UV-absorbing layer 84 is zinc oxide.

Figure 4:
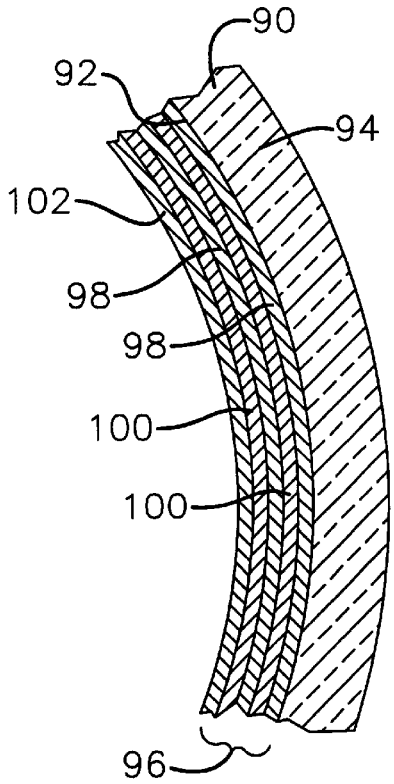
FIG. 4 is an enlarged cross sectional view of an alternative dichroic mirror, more specifically a cold mirror.

The cross-sectional view of FIG. 4 depicts an alternative, wherein a glass substrate 90 has internal and external surfaces 92 and 94, respectively, and a multilayer interference coating 96 is provided on the internal surface 92 only. The interference coating 96 comprises alternating thin films of materials 98 and 100 having different indices of refraction. A UV-absorbing coating layer 102 is also provided.

Located outside of the illumination reflector 22 is a source 110 of infrared radiation, in the form of an incandescent heat lamp 110. In the embodiment of FIGS. 1 and 2, the incandescent heat lamp 110 is located generally behind the apex 26. The heat lamp 110 is mounted on a suitable support 112 to the rear relamp door portion 42, and powered via conductor 114 extending from circuitry within the ballast housing 18. In the case of a 1000 to 2000 watt metal halide high intensity discharge lamp 20, a suitable source 110 of infrared radiation for heating the arc tube 50 is a 120 volt, 600 watt halogen incandescent lamp, such as a General Electric Company QUARTZLINE® lamp, intended for use as a projector lamp.

Infrared radiation from the heat lamp source 110 passes through the dichroic element portion 48 (cold mirror) of the illumination reflector 22 to preheat the arc tube 50 for purposes described hereinabove. Thus, preheating the arc tube 50 decreases the amount of damage done by starting, and additionally reduces the warm-up time.

In addition, because the dichroic element portion 48 (cold mirror) is only about 1% transmissive to visible light (approximately 4% of the total radiation is absorbed by the dichroic element portion 48), the amount of visible light from the heat lamp source 110 which enters the interior of the illumination reflector 22 is minimized, allowing the luminaire 10 to appear relatively dark during preheat.

For focusing infrared radiation from the incandescent heat lamp source 110 through the dichroic element portion 48 onto the arc tube 50, an infrared reflector 116 is provided, also located outside of the illumination reflector 22. In the illustrated embodiment, the infrared reflector 116 is located generally behind the apex 26, encompassing it. The infrared reflector 116 is made of any suitable infrared-reflecting material, preferably a specular reflecting material. To maximize heat transfer, the infrared reflector 116 is preferably elliptical, with the heat lamp 110 at one focus and the arc tube 50 at the other focus.

Heating of the arc tube 50 by infrared radiation from the heat lamp source 110 is further enhanced by a reflective shield 120 located within the illumination reflector 22 between the open end 24 and the arc tube 50, and conveniently mounted to the fixed optical louver 34. The shield 120 is reflective of both visible light and infrared radiation, and serves several functions.

In addition to enhancing preheating of the arc tube 50 by reflecting radiation from the heat lamp 110 onto the arc tube 50, the reflective shield 120 blocks light from the arc tube 50, which light inherently includes ultraviolet radiation, from radiating directly out through the open end 24 of the reflector 22. The illumination reflector 22, in addition to having at least a portion which is relatively reflective of visible light and relatively transmissive of infrared radiation, absorbs ultraviolet radiation through the provision of the UV-absorbing coating layer 84 (FIG. 3) or 102 (FIG. 4). Accordingly, the combination of the reflective shield 120 and the ultraviolet-absorbing illumination reflector 22 minimizes the amount of ultraviolet radiation which otherwise might be emitted by the luminaire 10, in the absence of other measures for limiting ultraviolet radiation, such as providing ultraviolet-filtering glass for the cover 28. Thus, the broken glass safety shutdown circuit of Speaker et al U.S. Pat. No. 5,400,223 potentially can be eliminated.

Figure 3:
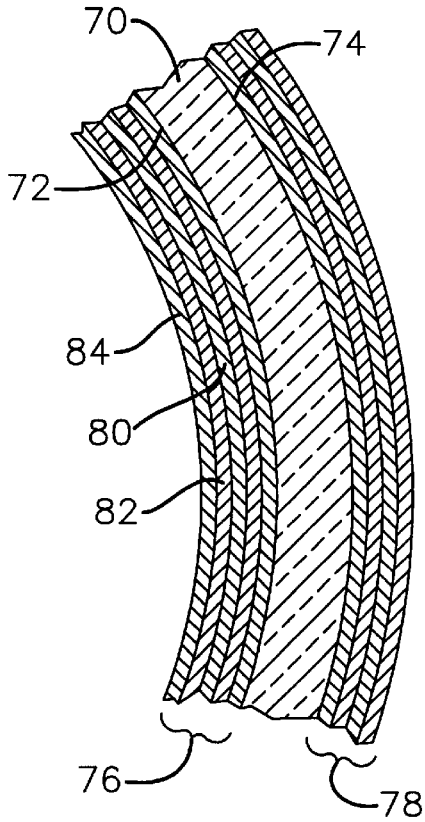
FIG. 3 is an enlarged cross sectional view of a dichroic mirror, more specifically a cold mirror, employed in the luminaire of FIGS. 1 and 2.

In FIGS. 3 and 4, the UV-absorbing coating layer 84 or 102 is on the surface of the multi-layer interference coating 76 (FIG. 3) or 96 (FIG. 4). However, if the multi-layer interference coating 76 or 96 is transparent to ultraviolet radiation, then the UV-absorbing layer can be located immediately adjacent the glass substrate 70 (FIG. 3) or 90 (FIG. 4). Alternatively, the multi-layer interference coating 76 or 96 itself can be designed so as to absorb ultraviolet radiation.

A third function of the reflector 120 is as a shatter shield, to deflect particles in the event of non-passive failure of the arc tube 50, and accordingly minimize the likelihood of damage to the glass cover 28.

A further aid to preheating the arc tube 50 is the shutter system 60. The movable louvers 62 can be closed during preheat while the heat lamp 110 is operating. Thus heat is deliberately contained within the housing 18, taking advantage of what would otherwise be an undesired effect in conventional use of a shutter system.

The shutter system 60 also serves a light-blocking purpose. The dichroic illumination reflector 22 does not entirely block visible light, and some visible light from the incandescent heat lamp 110 does enter the interior of the illumination reflector 22. With the inclusion of the shutter system 60, this visible light from the incandescent heat lamp 110 is nearly completely blocked when the movable louvers 62 of the shutter system 60 are closed, to achieve essentially total blackout notwithstanding operation of the incandescent heat lamp 110 for pre-heating the arc tube 50.

For hot starting the arc tube 50, appropriate circuitry may be included within the ballast 14 for generating relatively higher voltage pulses for starting, as is described in Speaker et al U.S. Pat. No. 5,444,334, or a hot restart starting aid tube 122 may be provided, such as is disclosed in Speaker et al U.S. Pat. No. 5,909,082.

During operation, the arc tube 50 is preheated, prior to starting, by operating the source of infrared radiation, namely the incandescent heat lamp 110, which is located outside the dichroic illumination reflector 22. Infrared radiation from the heat lamp 110 is directed onto the arc tube 50 through the dichroic illumination reflector 22, aided by the infrared reflector 116 which focuses infrared radiation from the heat lamp 110 onto the arc tube 50, and aided by the reflective shield 120. Also, while the incandescent heat lamp 110 is operating, the louvers 62 of the shutter system 60 are closed, to aid in containing heat within the housing 18. When the arc tube 50 is subsequently energized by the ballast 14 circuitry and thus started or restarted, the heat lamp 110 is turned off, and the louvers 62 of the shutter system 60 are opened. Such heating or preheating of the arc tube 50 can be effected either prior to initial starting of the arc tube 50, or after the arc tube 50 has been in operation and is turned off prior to a re-start, in which case the heat lamp 110 serves to maintain the arc tube 50 at an elevated temperature.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A luminaire comprising:

an illumination reflector having a forward, light-projecting open end and a rear apex;

an arc tube mounted generally in front of said rear apex;

at least a portion of said illumination reflector being a dichroic element which is relatively reflective of visible light and relatively transmissive of infrared radiation; and a source of infrared radiation located outside said illumination reflector for directing infrared radiation through said dichroic element portion of said illumination reflector to heat said arc tube.

2. The luminaire of claim 1, wherein said source of infrared radiation comprises an incandescent heat lamp.

3. The luminaire of claim 1, which further comprises an infrared reflector located outside of said illumination reflector for focusing infrared radiation from said source onto said arc tube.

4. The luminaire of claim 3, wherein said source of infrared radiation comprises an incandescent heat lamp.

5. The luminaire of claim 1, wherein said illumination reflector comprises an arc tube housing and said arc tube is mounted within said illumination reflector between said open end and said apex.

6. The luminaire of claim 5, which further comprises a shield located within said illumination reflector between said open end and said arc tube and reflecting at least infrared radiation for enhancing heating of said arc tube by said source of infrared radiation.

7. The luminaire of claim 6, wherein:

said shield blocks ultraviolet radiation and is configured so as to prevent ultraviolet radiation from radiating directly from said arc tube out through said open end of said reflector; and wherein said illumination reflector absorbs ultraviolet radiation.

8. The luminaire of claim 5, which further comprises a shutter mounted over said open end of said reflector for retaining heat within said arc tube housing when said source of infrared radiation is energized.

9. The luminaire of claim 1, wherein said dichroic element portion of said illumination reflector encompasses said rear apex.

10. The luminaire of claim 9, wherein said source of infrared radiation located outside said illumination reflector is located generally behind said apex.

11. The luminaire of claim 9, wherein said source of infrared radiation comprises an incandescent heat lamp.

12. The luminaire of claim 9, which further comprises an infrared reflector located outside of said illumination reflector generally behind said apex for focusing infrared radiation from said source onto said arc tube.

13. The luminaire of claim 12, wherein said infrared reflector encompasses said dichroic element portion of said illumination reflector; and wherein said source of infrared radiation comprises an incandescent heat lamp.

14. The luminaire of claim 9, wherein said illumination reflector comprises an arc tube housing and said arc tube is mounted within said illumination reflector between said open end and said apex.

15. The luminaire of claim 14, which further comprises a shield located within said illumination reflector between said open end and said arc tube and reflecting at least infrared radiation for enhancing heating of said arc tube by said source of infrared radiation.

16. The luminaire of claim 15, wherein:

said shield blocks ultraviolet radiation and is configured so as to prevent ultraviolet radiation from radiating directly from said arc tube out through said open end of said reflector; and wherein said illumination reflector absorbs ultraviolet radiation.

17. The luminaire of claim 1, which further comprises a starting aid to assist in hot starting said arc tube.

18. A method for preheating an arc tube in a luminaire including an illumination reflector having a forward, light-projecting open end and a rear apex, in which the arc tube is mounted generally in front of the rear apex, and wherein at least a portion of the illumination reflector is a dichroic element which is relatively reflective of visible light and relatively transmissive of infrared radiation, said method comprising directing infrared radiation through the dichroic element portion of the illumination reflector onto the arc tube from a source of infrared radiation located outside the illumination reflector.

19. The method of claim 18, which comprises employing an incandescent heat lamp as the source of infrared radiation.

20. The method of claim 18, which comprises employing an incandescent heat lamp as the source of infrared radiation and employing an infrared reflector located outside of the illumination reflector for focusing infrared radiation from the incandescent heat lamp onto the arc tube.

21. A luminaire comprising:

an illumination reflector having a forward, light-projecting open end and a rear apex;

an arc tube mounted generally in front of said rear apex;

at least a portion of said illumination reflector being a dichroic element, which is relatively reflective of visible light and relatively transmissive of infrared radiation;

a source of infrared radiation located outside said illumination reflector for directing infrared radiation through said dichroic element portion of said illumination reflector to heat said arc tube;

an infrared reflector located outside of said illumination reflector, generally behind said apex, for focusing infrared radiation from said source onto said arc tube; and wherein said infrared reflector encompasses said dichroic element portion of said illumination reflector.

22. A luminaire of claim 21, wherein said infrared reflector is being elliptical to maximize the heat transfer.

* * * * *